United States Patent [19]

Hendriksma et al.

[11] 4,345,015

[45] Aug. 17, 1982

[54] DISPERSION-HEAT PROCESS EMPLOYING HYDROPHOBIC SILICA FOR PRODUCING SPHERICAL ELECTROPHOTOGRAPHIC TONER POWDER

[75] Inventors: Roelof R. Hendriksma, Panningen; Wilhelmus J. VanRhijn, Venlo, both of Netherlands

[73] Assignee: Ocè-van der Grinten N.V., Venlo, Netherlands

[21] Appl. No.: 780,431

[22] Filed: Mar. 23, 1977

Related U.S. Application Data

[63] Continuation-in-part of Ser. No. 701,211, Jun. 30, 1976, abandoned.

[30] Foreign Application Priority Data

Jul. 7, 1975 [NL] Netherlands ..... 7508056

[51] Int. Cl.[3] ..... G03G 9/08

[52] U.S. Cl. ..... 430/137; 430/110; 430/111; 427/222; 428/407; 264/15; 241/5; 241/22; 51/316

[58] Field of Search ..... 252/62.1 R, 62.1 P; 96/1 SD; 427/222; 428/407; 264/15; 430/137, 110, 111; 241/5, 22, 16; 51/314, 316, 317

[56] References Cited

U.S. PATENT DOCUMENTS

| | | | |
|---|---|---|---|
| 2,877,133 | 3/1959 | Mayer | 430/110 |
| 3,333,031 | 7/1967 | Vincent et al. | 264/15 |
| 3,333,776 | 8/1967 | Rauner et al. | 241/22 |
| 3,400,000 | 9/1968 | Hoffman | 252/62.1 P |
| 3,586,654 | 6/1971 | Lerman et al. | 264/15 |
| 3,639,245 | 2/1972 | Nelson | 252/62.1 P |
| 3,674,736 | 7/1972 | Lerman et al. | 264/15 |
| 3,720,617 | 3/1973 | Chatterji et al. | 252/62.1 P |
| 4,029,613 | 6/1977 | Quinlan et al. | 428/407 |

*Primary Examiner*—John D. Welsh

*Attorney, Agent, or Firm*—Albert C. Johnston; Alphonse R. Noë

[57] ABSTRACT

Toner powders having excellent flow and non-agglomerating properties, and being readily removable from the imaging medium in use for indirect electrophotographic copying, are provided in the form of substantially spherical resin particles, containing additives or not as desired, which particles have been formed from irregularly shaped resin particles heated in a liquid dispersion containing hydrophobic silica particles smaller than 100 nanometers in diameter. The toner particles may be thus formed so as to carry on their surface or dispersed therein electrically conductive particles, such as carbon black, rendering them attractable by electrical inductance. The toner can be prepared simply by heating and stirring irregularly shaped resin particles and hydrophobic silica particles in a liquid carrier, such as water or a mixture of water and a water miscible organic solvent, that does not dissolve the resin, with heating to a temperature at which the resin particles soften until they become spherical or almost so, followed by cooling of the dispersion and separating and drying the toner particles.

8 Claims, No Drawings

DISPERSION-HEAT PROCESS EMPLOYING HYDROPHOBIC SILICA FOR PRODUCING SPHERICAL ELECTROPHOTOGRAPHIC TONER POWDER

This is a continuation-in-part of copending application Ser. No. 701,211, filed June 30, 1976, now abandoned.

This invention relates to toner powder which consists of solid, spherical or almost spherical particles containing thermoplastic resin, as well as to a process for producing such a toner powder.

For developing electrostatic images formed, e.g., in electrophotographic copying processes, on a photoconductive surface, toner particles consisting of colored or black thermoplastic resin particles are frequently applied. These toner powders can be deposited according to various methods on to the electrostatic image. Well-known methods include the cascade and magnetic brush methods, with which a developer powder is used consisting of a mixture of toner particles and carrier particles. Through triboelectric charging against the carrier particles the toner particles are charged electrostatically. The composition of the toner particles and of the carrier particles is chosen such that the toner particles acquire a charge which is of opposite polarity to that of the electrostatic image to be developed. According to the cascade method the developer powder is dredged over the image-bearing surface, whereby toner particles are pulled loose from the carrier particles as a result of the opposite charges of the electrostatic image, and retained on the image portions.

According to the magnetic brush method the powder mixture, now containing magnetically attractable carrier particles, is carried by magnetic transport means to the electrostatic image. The carrier particles are retained in the magnetic field of the magnetic transport means and thus form a brush to which the toner particles are bound electrostatically. Other known developing methods, which are also based on the deposition of electrostatically charged toner particles on to an electrostatic image, include aerosol development and fur-brush development.

According to the aerosol developing process toner power is carried in a gas stream over a suitable material, against which it is charged triboelectrically and then transported to the electrostatic image. According to the fur-brush method the toner powder is applied to a brush roller, where it is charged electrostatically as a result of friction against the bristles and, subsequently, the brush roller carries it to the electrostatic image.

Developing methods with which toner powders having a relative electrical conductivity are deposited on to an electrostatic image are also known. According to these developing methods an uncharged toner powder, having so high an electrical conductivity that it can be applied by inductive attraction to an electrostatic image, is brought in contact with the electrostatic image to be developed, or the imagebearing surface is carried through a reservoir filled with the relatively conductive toner powder, after which the excess powder is removed by knocking, blowing or exhausting.

In general, the toner powders consist of a thermoplastic resin or a mixture of thermoplastic resins, in which coloring material such as carbon black, red-lead, chrome yellow or organic dye is finely dispersed. Where the toner powder is charged triboelectrically the toner particles may further contain a so-called polarity control agent ensuring that the particles on being charged triboelectrically acquire a charge of the correct polarity. This polarity control agent may be homogeneously dispersed in the toner particles, or be deposited on to the surface of the toner particles. A lot of organic dyes are useful as a polarity control agent. Known polarity control agents include nigrosine base, nigrosine chloride, crystal violet and safranine dyes.

In addition to thermoplastic resin and coloring material, toner powders for being deposited by inductive attraction on to an electrostatic image contain electrically conductive material in order to give the desired electric conductivity to the toner powder. The electrically conductive material may be dispersed in the resin particles, or be deposited on to its surface. Generally, carbon black is used as conductive material, but other materials such as metal powder, metal salts, conductive donor-acceptor complexes and antistatic substances are applied as well.

To be able to obtain a large number of quality copies with the toner powders these powders must satisfy high demands. This includes the requirements that the toner powders should be resistant to mechanical stresses acting continually on them in the developing apparatus. If the mechanical resistance of the powders is too low, they will soon be polished off, notably in high-speed developing apparatus, resulting in the formation of fine dust being deposited on the background of the copies and/or on the carrying particles used in combination with the toner particles, the triboelectric properties of the developing powder thus being deranged. If the toner powder is used in a so-called indirect electrophotographic copying process, i.e. in a process in which a toner powder image is formed on a photoconductive intermediate followed by transferring the image to a receiving material, after which the intermediate is cleaned and used for a subsequent copying cycle, the fine dust may adhere to the intermediate, its life thus being considerably shortened. Other demands the toner powders have to satisfy are, that they may not coagulate at temperatures prevailing in the developing apparatus, which temperatures can rise up to approx. 50° C. in high-speed, prolonged operated apparatus, and that the powders, when applied in indirect electrophotographic copying processes, must be removable from the photoconductive intermediate without subjecting its surface to a high mechanical load causing quick damage to that surface. Toner powders of which the separate particles are solid and spherical, or substantially spherical, in shape are preferred because they have a higher mechanical resistance and better flow properties than toner powders consisting of irregularly shaped or of hollow, spherical particles. Spherical toner powders can be obtained by spraying a melt or solution of thermoplastic resin, in which coloring material, polarity control agent or electrically conductive material and, if so required, other additives have been dissolved or finely dispersed. However, this preparing method has the disadvantage that a complex apparatus is required, and if preparation occurs from a solution of the resin there is the added disadvantage that hollow, spherical particles having too low a mechanical resistance are usually obtained. Further, preparation of the toner powder by spraying a melt of the thermoplastic resin is only practicable with resins of which a low-viscous melt can be prepared.

The invention relates to an improved toner powder that satisfies high requirements as to quality and, consequently, is particularly suitable for use in high-speed indirect electrophotographic processes. The invention also provides an improved process for producing the toner powder. The improved toner powder according to the invention consists of solid, spherical, or almost spherical thermoplastic resin particles, which may or may not contain additives, and which have been formed from irregularly shaped resin particles in a heated liquid dispersion of them containing hydrophobic silica particles having a particle size of below 100 nanometers. The toner particles according to the invention are outstanding because of their excellent flow properties, slight tendency to coagulate and by their ready removability from the known photoconductive intermediates, thus making them particularly suitable for use in high-speed copiers working according to the principles of indirect electrophotography. Hydrophobic silica particles are understood to mean here silica particles of which at least 75% of the hydroxyl groups present on the surface have been etherified with a hydrophobic organic rest. Such hydrophobic silica particles are obtained by reacting the free hydroxyl groups on the surface with an organic compound which is reactive towards a hydroxyl group. The organic compound may be, for example: an alkyl halide or aryl halide, an aldehyde, an alcohol, a halogene silane or a silanol. Hydrophobic silica powders having a particle size of below 100 nanometers are commercially available. In these trade products the hydroxyl groups on the surface have usually been etherified by reacting them with a halogene silane, such as dimethyldichlorosilane.

The thermoplastic resin in the toner particles may be one of the resins known in the production of toners, which have a softening point between 50° and 130° C. and, preferably, between 65° and 115° C. Examples of such resins are polystyrene, copolymers of styrene with acrylate and/or methacrylate, polyvinyl chloride, copolymers of vinyl chloride with vinyl acetate, polyacrylates, polymethacrylates, polyamides, and polyester resins. The toner particles may, of course, also contain blends of two or more of such resins.

The resin particles according to the invention are solid and spherical, or substantially spherical in shape, and have a particle size of below 50 micrometers, preferably between 5 and 40 micrometers.

The toner particles according to the invention may contain the conventional additives such as coloring material, for example carbon black, red-lead, chrome yellow or organic dyes, and magnetically attractable material, for example iron powder or nickel powder, chromium oxide, iron oxide, or ferrite of the general formula $MFe_2O_4$, in which M is a bivalent metal, such as nickel, zinc, manganese or cobalt.

The toner particles, subject to whether they are charged triboelectrically or deposited by inductive attraction on to an electrostatic image, may further contain a polarity control agent or electrically conductive material, respectively. As polarity control agent the substances known for this purpose, such as nigrosine base, nigrosine hydrochloride, Safranine T, Neutral Red, Janus Blue, Nile Blue, Victoria Blue and crystal violet may be used. Preferably, the polarity control agent is present in a dissolved state in the toner particles but, as is well known, it may also be finely dispersed in the toner particles, or be deposited together with the hydrophobic silica particles on the surface of the toner particles. In case the toner particles are deposited by inductive attraction on to an electrostatic image, it is possible to use carbon black, metal powder, metal salts, antistatic substances and conductive donor-acceptor complexes as electrically conductive material. The electrically conductive material may be finely dispersed in the toner particles, or be deposited on the surface of the toner particles. Which specific resistance the toner powders being deposited by inductive attraction on to a charge pattern should have, strongly depends on the way in which the powder is brought into contact with the electrostatic image, the composition and electric properties of the material carrying the electrostatic image to be developed, as well as on the development time. Generally, the resistance of these toner powders should be lower than $10^{13}$ ohm.cm, if measured in accordance with the methods described in Example I of the British Pat. No. 1,406,983.

In the process according to the invention for preparing the solid spherical or almost spherical toner particles, irregularly shaped resin particles, which may contain additives such as coloring material, magnetically attractable material and polarity control agent or electrically conductive material, are dispersed together with hydrophobic silica particles having a particle size of below 100 nanometers in a carrier liquid in which the thermoplastic resin or resins do(es) not dissolve. Subsequently the dispersion is heated, whilst stirring, to a temperature at which the resin particles soften to such an extent that they acquire a spherical or substantially spherical shape. Said temperature is maintained until all the resin particles have become spherical or substantially spherical in shape. Subsequently, the dispersion is cooled down to a temperature at which the resin particles are no longer sticky. Finally, the spherical resin particles are separated from the dispersion, and dried. Surprisingly it was found that in a carrier liquid in which the resin does not dissolve, a dispersion of irregularly shaped resin particles and hydrophobic silica particles can be heated, whilst stirring, to a temperature at which the resin particles soften to such an extent that they acquire a spherical shape. On the other hand, if a dispersion of irregularly shaped resin particles is heated, whilst stirring, in the same carrier liquid in which, however, no hydrophobic silica particles are present, the resin particles will coagulate at a temperature lying below the temperature at which the resin particles acquire a spherical shape. This coagulation cannot be avoided by stirring the dispersion more vigorously.

The process according to the invention has the great advantage that solid, spherical or substantially spherical toner particles are obtained in a simple way, whilst using simple apparatus. The irregularly shaped resin particles, from which the spherical or substantially spherical toner particles are produced according to the process of the invention, are obtained in the conventional way by grinding the resin to a powder.

If the irregularly shaped resin particles also have to contain additives, which usually will be the case, they are obtained be melting the thermoplastic resin, dissolving the necessary additives in the resin melt or dispersing them finely therein, cooling down the resin melt to a solid mass and, finally, grinding the solid mass to fine particles.

The carrier liquid, in which the irregularly shaped resin particles are converted into solid spherical toner particles should not dissolve the thermoplastic resin or resins of the resin particles. It may consist of water, or of a mixture of water with one or more water-miscible organic solvents. Preferably, the organic solvent is ethanol, but other watermiscible organic solvents such as methanol, isopropanol, glycerol, methylethyl ketone, acetone, methyl glycol, methylglycol acetate, tetrahydrofuran, dioxane and pyridine may also be used. The choice of the carrier liquid is determined, i.a., by the properties of the thermoplastic resin or resins the resin particles consist of. Preferably, the composition of the carrier liquid is chosen in such a way that the temperature at which the dispersion is to be heated in order to cause the irregularly shaped resin particles to acquire a spherical shape, is lower than 90° C. and, preferably, lower than 70° C. This requirement can usually be complied with, if the carrier liquid contains from 50 to 95% by volume of water and from 50 to 5% by volume of organic solvent, the organic solvent content being from 5 to 30% by volume if the resin has a softening point of below approximately 100° C. For example, if the resin particles are of a resin having a softening point between 80° and 100° C., such as epoxy resin, and the carrier liquid consists of a mixture of from 70 to 75% by volume of water and from 30 to 25% by volume of ethanol, the minimum temperature to which the dispersion is to be heated, in order to obtain spherical toner particles, amounts to 45° C. During preparation of the toner particles according to the process of the invention the dispersion may contain up to 500 g of resin particles per liter of carrier liquid. Preferably, it contains approximately 150 g of resin particles per liter of carrier liquid. The amount of hydrophobic silica particles to be added to the dispersion is very small and, generally, ranges from 0.2 to 2 parts by weight per 100 parts by weight of resin particles. The toner particles according to the invention may contain, as previously stated, other auxiliary agents, for example polarity control agent or electrically conductive material. These agents may be applied to the toner particles according to the invention via a separate processing step, for example in the way described in Example 5 of Belgian Pat. No. 808,829 or in the examples of British Pat. No. 1,406,983. Preferably, however, these agents are deposited onto the toner particles by dissolving or dispersing them in the carrier liquid in which the toner particles according to the invention are produced. The auxiliary agent (polarity control agent or electrically conductive material) may be added simultaneously with the hydrophobic silica particles to the carrier liquid, or at an earlier or later stage.

In the simplest and, consequently, most preferred embodiment the auxiliary agent and hydrophobic silica particles are dispersed simultaneously with the irregularly shaped resin particles at room temperature in the carrier liquid, and under continuous stirring the dispersion is heated to a temperature at which the resin particles become spherical in shape, while this temperature is maintained until the desired quantity of auxiliary agent has been deposited on to the resin particles having acquired a spherical shape.

In another possible embodiment of the process there is first prepared a dispersion of irregularly shaped resin particles and hydrophobic silica particles in the carrier liquid and, subsequently, this dispersion is heated, with continuous stirring, to the temperature at which the resin particles become spherical. In that case, the auxiliary agent is added to the dispersion, after all the resin particles have become spherical or while the resin particles acquire a spherical shape. Toner particles that can be deposited by inductive attraction on to an electrostatic image often consist of resin particles which bear very fine electrically conductive particles, such as carbon black or metal particles, on their surface and which may contain magnetically attractable material. Toner particles of this composition, which satisfy the high requirements as to quality, can be eminently prepared according to the process of the invention by adding during the production of spherical particles fine electrically conductive particles, preferably carbon black particles having a particle size below 500 nanometers, at any moment to the carrier liquid in an amount of 1 to 15 parts by weight per 100 parts by weight of resin particles.

The invention is further explained with reference to the following examples.

EXAMPLE 1

In a laboratory kneading machine 900 g of epoxy resin (Epikote 1007 from Shell Chem. Co.) are mixed at a temperature between 100° and 110° C. with a solution of 25 g of nigrosine base in 50 g of melted diphenyl-ortho-phthalate.

After a mixing time of approximately 20 minutes, 25 g of carbon black are added to the melt, and mixing is continued some further 30 minutes. The melt is then removed from the kneading machine and allowed to cool down to a solid mass. The solid mass is ground to particles having a particle size between 5 and 30 micrometers.

900 g of the irregularly shaped particles thus obtained are dispersed in a mixture of 1,500 $cm^3$ of ethanol and 4,500 $cm^3$ of water, after which 4 g of hydrophobic silica particles having an average diameter of 15 nanometers are added to the dispersion.

The dispersion is heated, with continuous stirring, to 50° C. and is kept at this temperature until all the resin particles have acquired a spherical shape. Subsequently, while continuous stirring is prolonged, the dispersion is rapidly cooled down to room temperature. This dispersion is filtered off, and the resin particles are air-dried.

Thus, spherical toner particles are obtained.

40 g of the spherical toner particles obtained are mixed in a powder mixer with 960 g of iron particles having a particle size between 40 and 300 micrometers.

The developer powder is applied in an electrophotographic copier as described in the Belgian Pat. No. 797,998. Many thousands of high quality copies are obtained.

EXAMPLE 2

1,500 g of epoxy resin having a softening point between 90° and 100° C. are melted, and 1,350 g of magnetically attractable iron oxide particles having a particle size of approximately 500 nanometers are homogeneously dispersed in the melt. The melt is then cooled down to a solid mass, and the solid mass is ground to particles having a largest diameter between 15 and 35 micrometers.

1,500 g of the irregularly shaped magnetically attractable resin particles thus obtained are dispersed in a mixture of 2,500 $cm^3$ of ethanol and 7,500 $cm^3$ of water Subsequently, 7.5 g of hydrophobic silica particles having an average diameter of 15 nanometers, and
620 g of a 30 percent.aqueous dispersion of carbon particles having a particle size between 10 and 250 nanometers.
are added to the dispersion.

Under continuous stirring, the dispersion is heated to 50° C., the warming-up rate being approximately 1.5° C. a minute. The temperature of the dispersion is maintained at 50° C., for approximately 4 minutes until all the resin particles have acquired the spherical shape. The dispersion is then cooled down rapidly to room temperature. Subsequently the dispersion is filtered off, the resin particles are washed with water, in order to remove loose carbon particles and hydrophobic silica particles. Thereafter the resin particles are air-dried. A toner powder consisting of spherical particles is obtained, the specific resistance of the powder, measured according to the first method described in Example 1 of the British Pat. No. 1,406,983, amounting to approximately $10^9$ ohm.cm.

The toner particles bear approximately 3% by weight of carbon particles on their surface.

If, in preparing the toner powder, the hydrophobic silica particles are left out of the dispersion, the resin particles will coagulate when the dispersion has reached a temperature of 35°–40° C.

The toner powder is applied in an electrophotographic copier as described with respect to FIG. 21 of the Belgian Pat. No. 790,905. The copier is fitted with a photographic belt being a support of polyesterfilm, of which both sides are provided with an electrically conductive layer consisting of cellulose-acetate butyrate and carbon particles in the weight ratio 1:4, and of which one side is provided with a photoconductive layer containing 7 parts by weight of pink zinc oxide and 1 part by weight of a mixture of polyvinyl acetate with an ethyl acrylate styrene copolymer (E 202 resin, from De Soto Chemical Company).

Over 4,000 copies of good quality are obtained per image area on the photoconductive belt.

EXAMPLE 3

A dispersion containing
1,000 g of irregularly shaped, magnetically attractable epoxy resin particles prepared according to Example 1,
12.5 g of hydrophobic silica particles having a particle size between 35 and 80 nanometers,
3,750 $cm^3$ of water, and
1,250 $cm^3$ of ethanol
is heated, with continuous stirring, to 50° C. After the resin particles have become spherical, 410 g of a 30 percent.aqueous carbon dispersion are added to the dispersion, while the temperature is maintained at approx. 50° C. After adding the carbon dispersion, the temperature of the mixture is maintained, with continuous stirring, for approximately 10 minutes at a value between 45° and 50° C. The dispersion is then cooled down to room temperature, and the spherical, coated resin particles are separated, washed and dried.

The toner powder consisting of spherical particles has a specific resistance of approximately $8\times10^8$ ohm.cm.

EXAMPLE 4

A dispersion containing
150 g of irregularly shaped polystyrene resin particles having a particle size between 10 and 30 micrometers,
80 g of a 30 percent.aqueous dispersion of carbon particles having a particle size between 10 and 250 nanometers,
3 g hydrophobic silica particles having an average particle size of approximately 15 nanometers,
300 ml of methyl glycol, and
700 ml of water
was heated, with continuous stirring, to 90° C. and kept at this temperature until all the resin particles had become spherical. Subsequently, while stirring was continued, the dispersion was cooled down to room temperature, and the coated spherical resin particles were filtered off, washed with water and air-dried. A toner powder consisting of spherical particles having a specific resistance of approximately $10^6$ ohm.cm was obtained.

Substantially the same results were obtained, when the toner powder was produced in a carrier liquid containing 150 ml of methylglycol acetate and 850 ml of water, or 100 ml of acetone and 900 ml of water, and in latter case the dispersion was heated to 75° C.

EXAMPLE 5

An electrically conductive toner powder consisting of spherical particles, which powder had a specific resistance of approximately $2\times10^6$ ohm.cm, was manufactured by use of a dispersion containing:
100 g of irregularly shaped resin particles having a particle size between 10 and 30 micrometers, consisting of a copolymer of styrene with butylacrylate,
6 g of a 30 percent.aqueous dispersion of carbon particles having a particle size between 10 and 300 nanometers,
1 g of hydrophobic silica particles having a particle size between 5 and 75 nanometers,
500 ml of ethanol, and
500 ml of water.
This dispersion was heated, with continuous stirring, to 70° C., which temperature was maintained for approx. 30 minutes, after which the dispersion was cooled down to room temperature. The coated spherical resin particles were separated from the carrier liquid and then airdried.

EXAMPLE 6

A dispersion containing:
150 g of irregularly shaped resin particles having a particle size between 10 and 30 micrometers, and consisting of of a terpolymer of styrene with indene and acrylonitrile,
7 g of a 30 percent.aqueous dispersion of graphite particles having a particle size of below 300 nanometers,
2.5 g of hydrophobic silica particles having a particle size between 10 and 75 nanometers,
300 ml of isopropanol, and
700 ml of water
was heated, while stirring, to 85° C. and this temperature was maintained until all the resin particles had acquired a spherical shape. The dispersion was then cooled down to room temperature, after which the coated resin particles were separated from the dispersion and dried in the way described in the previous examples.

The toner powder obtained had a specific resistance of approximately $10^4$ ohm.cm Substantially the same results were obtained when, instead of 300 ml of isopropanol, an equal quantity of ethanol, propanol or methyl glycol was used in the carrier liquid.

EXAMPLE 7

150 g of irregularly shaped resin particles having a maximum diameter between 10 and 25 micrometers, and consisting of 98% by weight of a terpolymer of styrene with indene and acrylonitrile, and 2% by weight of carbon black were dispersed in a liquid consisting of:

0.7 g of nigrosine
500 ml of ethanol
500 ml of demineralized water
2 g hydrophobic silica particles having a particle size between 10 and 75 nanometers.

The dispersion was heated, while stirring, to 70° C. and this temperature was maintained until all the resin particles had become substantially spherical. The dispersion was then cooled down, with continuous stirring, to room temperature, and the spherical resin particles being coated with nigrosine were separated from the dispersion, and dried. The solid, spherical toner particles thus obtained had approximately 0.015% by weight of nigrosine on their surface.

45 g of these toner particles were mixed with
995 g of iron carrier particles,
and the powder developer thus obtained was used in the electrophotographic copier of Example 1, producing copies of good quality.

We claim:

1. A process for producing spheroidized toner powder, characterized in that irregularly shaped thermoplastic resin particles, or such particles impregnated with additive, and hydrophobic silica particles having sizes below 100 nanometers are dispersed in a carrier liquid, in which liquid the resin of said resin particles does not dissolve, so as to form a dispersion containing less than 500 g. of said resin particles per liter of carrier liquid and hydrophobic silica particles in a small concentration sufficient to inhibit coagulation of said resin particles when softened; the dispersion is heated with stirring to a temperature at which said resin particles do not melt but soften and acquire a spherical or substantially spherical shape, and this temperature is maintained until substantially all the resin particles have become spherical or practically spherical in shape; the dispersion is then cooled down to a temperature at which the resin particles are no longer sticky and, finally, the resin particles are separated from the dispersion liquid, and dried.

2. Process according to claim 1, characterized in that the carrier liquid contains from 50 to 95% by volume of water and from 50 to 5% by volume of organic, water-miscible solvent.

3. Process according to claim 2, characterized in that the organic solvent is ethanol.

4. Process according to claim 1, characterized in that the dispersion contains from 0.2 to 2 parts by weight of hydrophobic silica per 100 parts by weight of resin particles.

5. Process according to claim 1, characterized in that, in addition, electrically conductive particles are added to the dispersion.

6. Process according to claim 1, wherein said carrier liquid consists essentially of from 50 to 95% by volume of water and from 50 to 5% by volume of water-miscible organic solvent and said dispersion contains from 0.2 to 2 parts by weight of hydrophobic silica per 100 parts of said resin particles.

7. Process according to claim 6, wherein said dispersion also contains fine electrically conductive particles sufficient to render the toner particles electrically conductive by adhering to the surfaces of said resin particles.

8. A process for producing spheroidized toner powder, which comprises dispersing irregularly shaped thermoplastic resin particles, or such resin particles impregnated with additive, and hydrophobic silica particles having sizes below 100 nanometers in a carrier liquid consisting essentially of 50 to 95% by volume of water and 50 to 5% by volume of water-miscible organic solvent that does not dissolve the resin of said resin particles, thus forming a dispersion containing less than 500 g. of said resin particles per liter of carrier liquid and from 0.2 to 2 grams of hydrophobic silica particles per 100 grams of said resin particles; heating said dispersion, with stirring, to a temperature at which said resin particles do not melt but soften and acquire a spherical or substantially spherical shape and maintaining such a temperature until substantially all said resin particles have become spherical or practically spherical in shape; then cooling the dispersion to a temperature at which the resin particles are no longer sticky, and finally separating the resin particles from the dispersion liquid and drying them.

* * * * *